United States Patent [19]

Meadows

[11] 4,211,457

[45] Jul. 8, 1980

[54] VACUUM CLEANING APPARATUS

[75] Inventor: Roger D. Meadows, Waynesville, N.C.

[73] Assignee: Dayco Corporation, Dayton, Ohio

[21] Appl. No.: 942,235

[22] Filed: Sep. 14, 1978

[51] Int. Cl.[2] ..... H01R 3/04

[52] U.S. Cl. ..... 339/15; 339/14 R

[58] Field of Search ..... 339/15, 16 R, 14 R

[56] References Cited

U.S. PATENT DOCUMENTS

| | | | |
|---|---|---|---|
| 3,737,623 | 6/1973 | Vallone | 339/14 R |
| 4,018,493 | 4/1977 | Lyman et al. | 339/15 |
| 4,063,790 | 12/1977 | Kleykamp et al. | 339/16 R |

*Primary Examiner*—Roy Lake

*Assistant Examiner*—DeWalden W. Jones

*Attorney, Agent, or Firm*—Reuben Wolk

[57] ABSTRACT

A vacuum cleaning apparatus comprising a current-carrying vacuum hose provided with a hose connector at one end thereof which has a pigtail-free shielded electrical connector assembly which is installed and self locked in position after assembly of the hose connector and which is particularly adapted to be directly connected with a female electrical connector in a housing assembly of a canister-type vacuum cleaner to thereby provide an economical construction which is also of optimum safety due to its self-locking character and shielding of its protruding metal male electrical connector.

12 Claims, 4 Drawing Figures

VACUUM CLEANING APPARATUS

BACKGROUND OF THE INVENTION

Tank or canister-type vacuum cleaners are well known and each employs the usual housing assembly which includes an electric motor driven vacuum unit and the housing assembly is provided with a hose connector for connection with a current-carrying vacuum hose and a female electrical connector for supplying electrical power to such vacuum hose. The current-carrying vacuum hose may be operatively connected to an electrically driven brush of a floor unit or other cleaning apparatus as is known in the art.

In this type of vacuum cleaner it is common practice to employ an electrical cable assembly often referred to as a pigtail for connecting the current-carrying vacuum hose to the female electrical connector of the housing assembly resulting in added cost for such pigtail. In addition, in the usual pigtail of this type the male electrical connector is a simple plug which must be connected with care to preclude the possibility of electrical shock.

There is also a tendency in a canister-type vacuum cleaner for the vacuum tube portion of the current-carrying vacuum hose to be disconnected from its housing assembly and with a pigtail type electrical connection the vacuum tube portion of the current-carrying hose is prone to be left dangling and held to the housing assembly only by its pigtail which could be partially disconnected thereby partially exposing hot electrical parts in an unsafe manner.

SUMMARY

It is a feature of this invention to provide a pigtail-free shielded electrical connector assembly which may be installed and self-locked in a hose connector of a current-carrying vacuum hose of a canister-type vacuum cleaner after manufacture and assembly of such hose and its connector with such electrical connector assembly being particularly adapted to be directly connected with a female electrical connector in a housing assembly of such canister-type vacuum cleaner to thereby provide an economical construction which is also of optimum safety due to its self-locking character and shielding of protruding metal male connector.

Another feature of this invention is to provide an improved canister-type vacuum cleaner having a housing assembly provided with a hose connector and a female electrical connector in the housing assembly immediately adjacent the hose connector with the housing assembly having a shield-receiving channel defined therein which is particularly adapted to receive a shield of a male electrical connector extending from an electrical connector assembly which is self-locked in a hose connector of a current-carrying vacuum hose of the character mentioned simultaneously with installing the hose connector of the vacuum hose in the hose connector of the housing assembly.

Another feature of this invention is to provide a current-carrying vacuum hose having a polymeric hose connector defining at least one end thereof and a female electrical connector device embedded in the hose connector. The hose connector has a cavity therein and at least one shoulder defining a wall portion of the cavity with the shoulder being disposed transverse the longitudinal axis of the hose connector and the female electrical connector device has a pair of tubular members embedded in the hose connector with the hose connector serving as a matrix for the tubular members. The vacuum hose also has an electrical connector assembly comprising a support structure having a cooperating shoulder provided thereon which is adapted to be urged in locking engagement against the one shoulder with the shoulders defining locking means for locking the electrical connector assembly to the hose connector; and, the electrical assembly also has a first male electrical connector device including a pair of pins each received in an associated tubular member of the female electrical connector device and a second male electrical connector device extending outwardly of the support structure and provided with a shield with the second male electrical connector device being adapted to be operatively connected with another female electrical connector device in a housing assembly of a canister-type vacuum cleaner with the shield received in a shield-receiving cavity in the housing assembly.

Accordingly, it is an object of this invention to provide a canister-type vacuum cleaner and a current carrying vacuum hose comprising same having one or more of the novel features set forth above or hereinafter shown or described.

Other details, features, objects, uses, and advantages of this invention will become apparent from the embodiment thereof presented in the following specification, claims, and drawing.

BRIEF DESCRIPTION OF THE DRAWING

The accompanying drawing shows a present preferred embodiment of this invention, in which.

DESCRIPTION OF ILLUSTRATED EMBODIMENT

Figure 1:
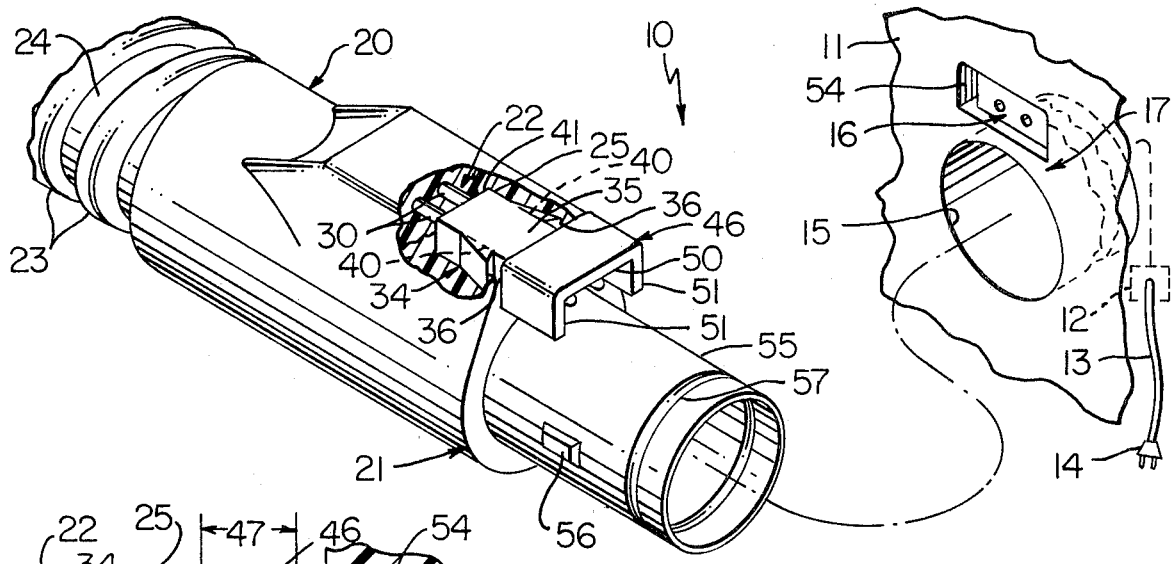
FIG. 1 is a perspective view with parts in elevation, parts in cross section, and parts broken away particularly illustrating a canister-type vacuum cleaner of this invention including an improved current-carrying vacuum hose comprising same.

Reference is now made to FIG. 1 of the drawing which illustrates a fragmentary portion of an exemplary canister-type vacuum cleaner of this invention which is designated generally by the reference numeral 10. The vacuum cleaner 10 comprises a housing assembly 11 defining the tank or canister thereof and such assembly has a vacuum unit designated schematically by a dotted rectangle 12 suitably supported therein and electrical power is provided to the housing assembly 11 for its vacuum unit 12 and all components associated with the cleaner 10 through an electrical cord 13 provided with a plug 14 for connection to a source of electrical power.

Figure 4:
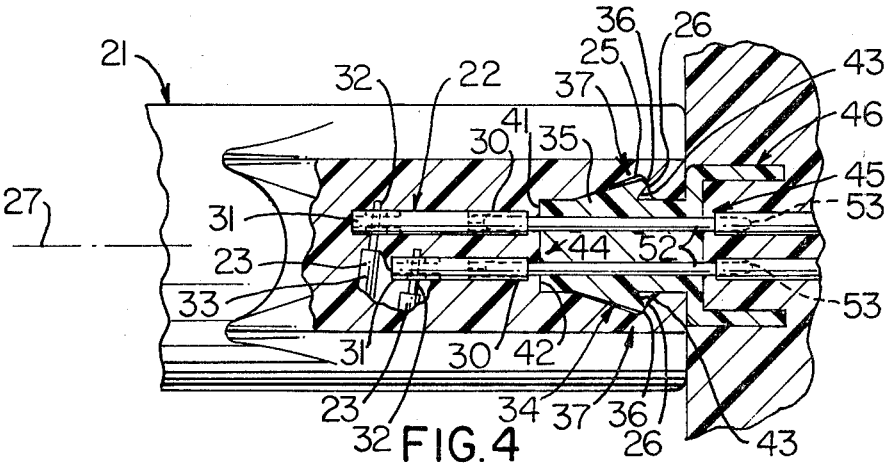
FIG. 4 is a fragmentary cross-sectional view taken essentially on the line 4—4 of FIG. 3.

The housing assembly 11 has a first hose connector shown in this example as a female hose connector 15 and a first female electrical connector designated generally by the reference numeral 16 disposed immediately adjacent the hose connector 15 and as shown at 17 in FIG. 1. The vacuum cleaner 10 also comprises a current-carrying vacuum hose assembly which will be referred to simply as a vacuum hose 20 which has a male hose connector 21 defining at least one end thereof and a female electrical connector 22, also see FIG. 4, embedded in the hose connector 21.

The vacuum hose 20 has a suitable connector at its opposite end (not shown) which is particularly adapted to be connected with a component of the vacuum cleaner 10 such as a floor cleaning unit or other cleaning accessory which is driven by an electric motor and such motor is supplied with electrical power from the female electrical connector 22 by electrically insulated dual-purpose electrical conductor and reinforcing wires 23 which are helically wound along the tube portion 24 of the vacuum hose 20.

The male hose connector 21 has a cavity 25 defined therein and a pair of symmetrically arranged opposed shoulders 26 defining opposed or oppositely arranged wall portions of the cavity 25. The shoulders 26 are disposed transverse a longitudinal axis 27 of the hose connector 21 and the purpose of the shoulders 26 will be described in detail subsequently.

The female electrical connector 22 is comprised of a pair of tubular members each designated by the same reference numeral 30 embedded in the male hose connector 21 and in particular in the polymeric material defining such hose connector which serves as a matrix for the tubular members 30. The tubular members 30 may be of any suitable type known in the art; and, in this example each of such members 30 has a rear portion 31 which is mechanically and electrically connected to an associated metal wire portion 32 of a wire 23 after having removed or stripped away the insulating sleeve 33 from around such wire portion, and as is known in the art.

The vacuum hose 20 also has an electrical connector assembly which is designated generally by the reference numeral 34 and which comprises a support structure 35 having a pair of cooperating shoulders 36 thereon each of which is adapted to be urged in locking engagement with an associated shoulder 26. The shoulders 26 and 36 define locking means which will be designated generally by the reference numeral 37 for locking the electrical connector assembly to the hose connector 21.

The cooperating shoulders 36 of the support structure 35 are yielding resilient shoulders and as the assembly 34 and in particular the support structure 35 thereof is moved within the cavity 25 the shoulders 36 are compressed inwardly as indicated by dotted lines 40 in FIG. 1; and, as a terminal end surface 41 of the assembly 34 bottoms against a cooperating surface 42 within the male hose connector 21 and defining a wall of cavity 25, each shoulder 26 snaps or moves outwardly so that the tip portion of its inclined surface 43 engages an associated shoulder 26. This particular construction is essentially the type construction employed in similar components disclosed in the U.S. Pat. No. 4,063,790 assigned to applicant's assignee.

Figure 3:
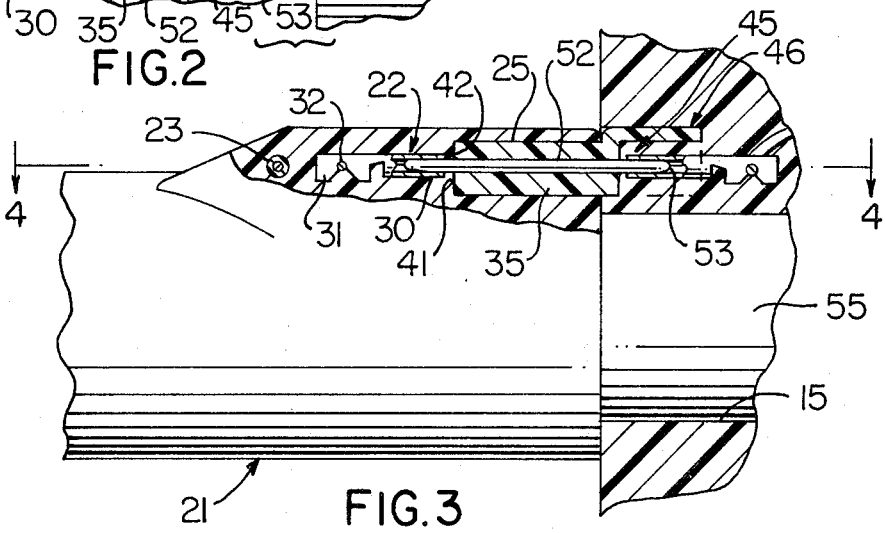
FIG. 3 is a fragmentary view with parts in elevation and parts in cross section showing a fragmentary portion of the hose connector of FIGS. 1 and 2 and its electrical connector assembly with the male electrical connector installed in position within the female electrical connector in the housing assembly of FIG. 1.

The electrical connector assembly 34 has a first male electrical connector 44 defined by a pair of pins and each of such pins is received in an associated tubular member 30 of the female electrical connector 22; and, the electrical connector assembly 34 has a second male electrical connector 45 defined by a pair of pins extending outwardly from the opposite end of its support structure 35. The electrical connector 45 is received within the female electrical connector 16 upon operatively connecting the hose connector 21 within the hose connector 15 and as shown in FIG. 3, for example.

Figure 2:
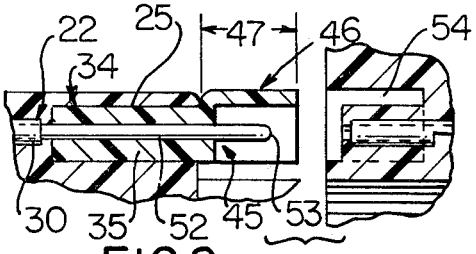
FIG. 2 is a fragmentary view with parts in elevation and parts in cross section particularly illustrating a fragmentary portion of a hose connector defining one end of a current-carrying vacuum hose particularly illustrating an electrical connector assembly thereof having a shielded male electrical connector prior to installation of such male electrical connector within a female electrical connector in the housing assembly of the canister-type vacuum cleaner of FIG. 1.

As seen in FIGS. 1 and 2 the electrical assembly 34 also comprises a shield 46 which is fixed to the support structure 35 and in this example of the invention the shield 46 and support structure 35 are made of an electrically insulating polymeric material as a single-piece construction. The shield 46 is provided for the purpose of shielding the male electrical connector 45 and such shield has an axial length 47 measured substantially parallel to the longitudinal axis 27 which is at least equal to the axial length of the electrical connector 45 and preferably the length 47 of shield 46 is substantially greater than the axial length of the male electrical connector 45. The shield 46 has a roughly U-shaped cross-sectional configuration at each position thereof along its axial length and the U-shaped configuration is defined by a bight 50 and a pair of legs 51 extending from opposite end of such bight.

The electrical connector assembly 34 is comprised of a pair of elongate members in the form of a pair of straight rods each designated by the same reference numeral 52 and the rods 52 have rounded ends 53. The rods 52 are embedded in parallel relation in the support structure 35 and have portions extending from opposite ends thereof with the portions extending from the inner end (end opposite the shield 46) of the support structure 35 defining what have been described previously as the pair of pins of the electrical connector 44 and the portions extending from the opposite or outer end of the support structure 35 defining what have been described as the pair of pins of the electrical connector 45.

The housing assembly 11 also has a shield-receiving channel 54 defined therein and such shield-receiving channel is of roughly U-shaped cross-sectional configuration and is particularly adapted to receive the U-shaped shield 46 therewithin. In particular, the shield receiving channel 54 is in the form of a U-shaped channel or groove and once the male hose connector 21 is installed within the hose connector 15 the shield 46 is received within its associated shield receiving channel 54.

As seen in FIG. 1, the hose connector 21 has a tubular portion 55 protruding therefrom and such tubular protrusion 55 has a pair of diametrically disposed projections 56 extending therefrom and an annular groove 57 in its terminal end portion. Each projection is adapted to be received in a groove (not shown) provided in the housing 11 whereby the projections 56 serve as means preventing rotation of the hose connector 21 and hence the vacuum hose 20 once it is installed in the housing assembly 11. The groove 57 is adapted to receive a projection from the housing 11 therewithin to prevent easy axial withdrawal thereof.

The shielded electrical connector assembly 34 is of optimum simplicity and the manner in which the shield 46 thereof is received within the shield-receiving channel 54 makes it very difficult if not impossible for one to receive an electrical shock during the process of connecting the vacuum hose 20 to the housing assembly or canister 11 as well as during use where the vacuum hose 20 might tend to be disconnected from the housing assembly 11.

The vacuum hose 20 including the hose connectors provided at opposite ends thereof, the housing assembly 11, and the support structure 35 of the electrical connector assembly 34, may be made of any suitable polymeric material known in the art. Preferably such components are made of synthetic plastic material such as high molecular weight polymers including but not being limited to polyvinyl chloride, polyethylene, polypropelene, nylon, and the like.

While present exemplary embodiments of this invention, and methods of practicing the same, have been illustrated and described, it will be recognized that this invention may be otherwise variously embodied and practiced within the scope of the following claims.

What is claimed is:

1. In a current-carrying vacuum hose having a polymeric hose connector defining at least one end thereof and a female electrical connector embedded in said hose connector; said hose connector having a cavity therein and at least one shoulder defining a wall portion of said cavity; said shoulder being disposed transverse the longitudinal axis of said hose connector; said female electrical connector having a pair of tubular members embedded in said hose connector which serves as a matrix therefor; the improvement comprising an electrical connector assembly which comprises, a support structure having a cooperating shoulder provided thereon which is adapted to be urged in locking engagement against said one shoulder, said shoulders defining locking means for locking said electrical connector assembly to said hose connector, a first male electrical connector having a pair of pins each received in an associated tubular member of said female electrical connector, and a second male electrical connector extending outwardly of said support structure which is adapted to be operatively associated with another female electrical connector, said assembly comprising a shield fixed to said support structure for shielding said second male electrical connector, said shield having an axial length measured substantially parallel to said longitudinal axis which is at least equal to the axial length of said second male electrical connector, said shield also having a roughly U-shaped cross section at each axial position thereof along its axial length, said shield and support structure being made of an electrically insulating polymeric material as a single piece, said electrical connector assembly with its shield, support structure, and first and second male elecrical connectors being a single unit which is locked to said hose connector by said locking means.

2. In a hose as set forth in claim 1 the further improvement in said assembly comprising a pair of elongate members embedded in parallel relation in said support structure, said members having portions extending from one end of said support structure defining the pair of pins of said first male electrical connector and having opposite portions extending from the opposite end of said support structure defining said second male electrical connector.

3. In a hose as set forth in claim 2 the further improvement in said assembly wherein said support structure is defined of a compressible resilient polymeric material having said cooperating shoulder defined thereon.

4. In a hose as set forth in claim 3 the further improvement in said assembly wherein said cooperating shoulder has a compressible apex which is adapted to be yieldingly compressed into engagement with said one shoulder, said compressible apex serving to yieldingly hold said assembly in locked engagement.

5. In a hose as set forth in claim 1 wherein said hose connector has another shoulder therein disposed transverse its longitudinal axis and symmetrically arranged with said first-named one shoulder to define an opposed wall portion of said cavity, the further improvement in said assembly comprising another cooperating shoulder extending from said support structure at a location opposite from said first-named cooperating shoulder to define symmetrically arranged cooperating shoulders extending from said support structure each of said cooperating shoulders engaging an associated shoulder of said cavity.

6. In a hose as set forth in claim 5 the further improvement comprising means on said hose connector for preventing rotation thereof about said longitudinal axis.

7. In a cannister-type vacuum cleaner comprising; a housing assembly having a first hose connector and a first female electrical connector; a current-carrying vacuum hose having a second hose connector defining at least one end thereof and a second female electrical connector embedded in said second hose connector; said second hose connector having a cavity therein and at least one shoulder defining a wall portion of said cavity; said shoulder being disposed transverse a longitudinal axis of said second hose connector; said second female electrical connector having a pair of tubular members embedded in said second hose connector which serves as a matrix therefor; the improvement comprising an electrical connector assembly which comprises, a support structure having a cooperating shoulder thereon which is adapted to be urged in locking engagement against said one shoulder; said shoulders defining locking means for locking said electrical connector assembly to said second hose connector, a first male electrical connector having a pair of pins each received in an associated tubular member of said female electrical connector, and a second male electrical connector extending outwardly from said support structure which is received within said first female electrical connector upon operatively connecting said second hose connector with said first hose connector, said housing assembly having a shield-receiving channel defined therein and said electrical connector assembly having a shield defined as an integral part of said support structure for shielding said second male electrical connector, said shield being adapted to be received in said shield-receiving channel, said shield having an axial length measured substantially parallel to said longitudinal axis which extends beyond the axial length of said second male electrical connector, said shield also having a roughly U-shaped cross section at each axial position thereof along its axial length, said shield and support structure being made of an electrically insulating synthetic plastic material as a single piece, said electrical connector assembly with its shield, support structure, and first and second male electrical connectors being a single unit which is locked to said second hose connector by said locking means.

8. In a vacuum cleaner as set forth in claim 7 wherein said second hose connector has at least another shoulder therein disposed transverse its longitudinal axis and symmetrically arranged with said first-named one shoulder to define an opposed wall portion of said cavity, the further improvement in said assembly comprising another cooperating shoulder extending from said support structure at a location oppsite from said first-named cooperating shoulder to define symmetrically arranged cooperating shoulders extending from said support structure, each of said cooperating shoulders engaging an associated shoulder of said cavity.

9. In a vacuum cleaner as set forth in claim 8 the further improvement in said electrical connector assembly comprising a pair of elongate members embedded in parallel relation in said support structure, said members having portions extending from one end of said support structure defining the pair of pins of said first male electrical connector and having opposite portions extending from the opposite end of said support structure defining said second male electrical connector.

10. In a vacuum cleaner as set forth in claim 9 the further improvement in said electrical connector assembly wherein said support structure is defined of a compressible resilient polymeric material having said cooperating shoulders defined thereon.

11. In a vacuum cleaner as set forth in claim 10 the further improvement in said electrical connector assembly wherein each of said cooperating shoulders has a compressible apex which is adapted to be yieldingly compressed into engagement with an associated shoulder of said cavity, said compressible apexes serving to yieldingly hold said electrical connector assembly in locked engagement.

12. In a vacuum cleaner as set forth in claim 11 the further improvement comprising at least one projection on said second hose connector for preventing rotation thereof once installed in said first hose connector of said housing assembly.

* * * * *